US006141887A

United States Patent [19]

Chen et al.

[11] Patent Number: 6,141,887

[45] **Date of Patent: *Nov. 7, 2000**

[54] SYSTEM AND METHOD FOR SENSING THE DRYNESS OF CLOTHING ARTICLES

[75] Inventors: Yu-To Chen, Niskayuna; Mark Edward Dausch, Latham; Nicolas Wadih Chbat, Albany; Vivek Venugopal Badami, Schenectady, all of N.Y.

[73] Assignee: General Electric Company, Schenectady, N.Y.

[ * ] Notice: This patent is subject to a terminal disclaimer.

[21] Appl. No.: 08/816,590

[22] Filed: Mar. 13, 1997

[51] Int. Cl.[7] ..... F26B 21/06

[52] U.S. Cl. ..... 34/475; 34/491; 34/495; 34/557; 34/565

[58] Field of Search ..... 34/491, 474, 475, 34/495, 496, 497, 535, 557, 549, 565; 340/660; 318/798, 799, 805, 806; 219/490, 494, 497

[56] References Cited

U.S. PATENT DOCUMENTS

| | | | |
|---|---|---|---|
| 4,586,267 | 5/1986 | Sussman . | |
| 5,006,778 | 4/1991 | Bashark . | |
| 5,281,956 | 1/1994 | Bashark | 340/660 |
| 5,570,520 | 11/1996 | Huffington | 34/535 |
| 5,899,005 | 5/1999 | Chen et al. | 34/528 |

FOREIGN PATENT DOCUMENTS

| | | |
|---|---|---|
| 4197398A | 7/1992 | Japan . |
| 4300595A | 10/1992 | Japan . |
| 5084398A | 4/1993 | Japan . |

OTHER PUBLICATIONS

U.S. Patent Application "System and Method for Predicting the Dryness of Clothing Articles" by Y.Chen, et al, Attorney Docket No. RD–25,237, Serial No. 08/816591, filed Mar. 13, 1997.

*Primary Examiner*—Pamela A. Wilson
*Attorney, Agent, or Firm*—Dave C. Goldman; Jill M. Breedlove

[57] ABSTRACT

A system and method for sensing the dryness of clothing articles in a clothes dryer. In one embodiment, the clothes dryer uses a temperature sensor and a phase angle sensor to determine the dryness of the clothing articles as a function of the heated air temperature and the motor phase angle. In another embodiment the clothes dryer uses a humidity sensor to determine the dryness of the clothing articles as a function of the humidity of the heated air temperature. In a third embodiment the clothes dryer uses a temperature sensor, a phase angle sensor, and a humidity sensor to determine the dryness of the clothing articles as a function of the heated air temperature, the motor phase angle, and the humidity of the heated air temperature.

59 Claims, 12 Drawing Sheets

Median of p-p Phase Change
P(i)
0.9
0.8
0.7
0.6
0.5
1
2
3
4
5
6
7
9
10
11
Step

Clothes Temperature
T(i)
130
120
110
100
90
5
10
15
20
25
30
Step

% Water Retention
60
40
20
5
10
15
20
25
30
Step

SYSTEM AND METHOD FOR SENSING THE DRYNESS OF CLOTHING ARTICLES

FIELD OF THE INVENTION

The present invention relates generally to an appliance for drying articles, and more particularly to a system and method for sensing the dryness of the articles in the appliance.

BACKGROUND OF THE INVENTION

Typically, an appliance for drying articles such as a clothes dryer for drying clothing articles uses an open control loop to dry the articles. The open control loop allows a user to set a drying time for drying the clothing articles. Setting the drying time requires an estimation by the user of when the clothing articles will be dry and generally results in the articles being either over-heated or under-heated. Over-heating of clothing articles results in unnecessary longer drying times, higher energy consumption, and the potential for damaging the articles. On the other hand, under-heating causes great inconvenience because the user has to reset the drying time and wait again for the clothing articles to be dry. Accordingly, there is a need for a clothes dryer that can automatically sense the dryness of the clothing articles in a dryer without having to rely on a user's subjective estimation of the drying time.

SUMMARY OF THE INVENTION

In accordance with a first embodiment of this invention, there is provided an appliance such as a clothes dryer for drying clothing articles. In this embodiment, the dryer comprises a container for receiving the clothing articles. A motor rotates the container about an axis. A heater supplies heated air to the container. A duct directs the heated air outside the container. A temperature sensor senses the temperature of the heated air and provides signal representations thereof. A phase angle sensor senses the motor phase angle and provides signal representations thereof. A controller responsive to both the temperature sensor and the phase angle sensor determines the dryness of the clothing articles in the container as a function of the heated air temperature and the motor phase angle.

In accordance with a second embodiment of this invention, there is provided an appliance such as a clothes dryer for drying clothing articles. In this embodiment, the dryer comprises a container for receiving the clothing articles. A heater supplies heated air to the container. A duct directs the heated air outside the container. A humidity sensor senses the humidity of the heated air in the duct and provides signal representations thereof. A controller responsive to the humidity sensor determines the dryness of the clothing articles in the container as a function of the humidity of the heated air. The clothing articles are dry when the humidity signal representations are within a predetermined humidity range and when difference values of the humidity signal representations are within a predetermined interval.

In accordance with a third embodiment of this invention, there is provided an appliance such as a clothes dryer for drying clothing articles. In this embodiment, the dryer comprises a container for receiving the clothing articles. A motor rotates the container about an axis. A heater supplies heated air to the container. A duct directs the heated air outside the container. A temperature sensor senses the temperature of the heated air and provides signal representations thereof. A phase angle sensor senses motor phase angle and provides signal representations thereof. A humidity sensor senses the humidity of the heated air in the duct and provides signal representations thereof. A controller responsive to the temperature sensor, the phase angle sensor, and the humidity sensor determines the dryness of the clothing articles in the container as a function of the heated air temperature, the motor phase angle, and the humidity of the heated air.

DETAILED DESCRIPTION OF THE INVENTION

Figure 1:
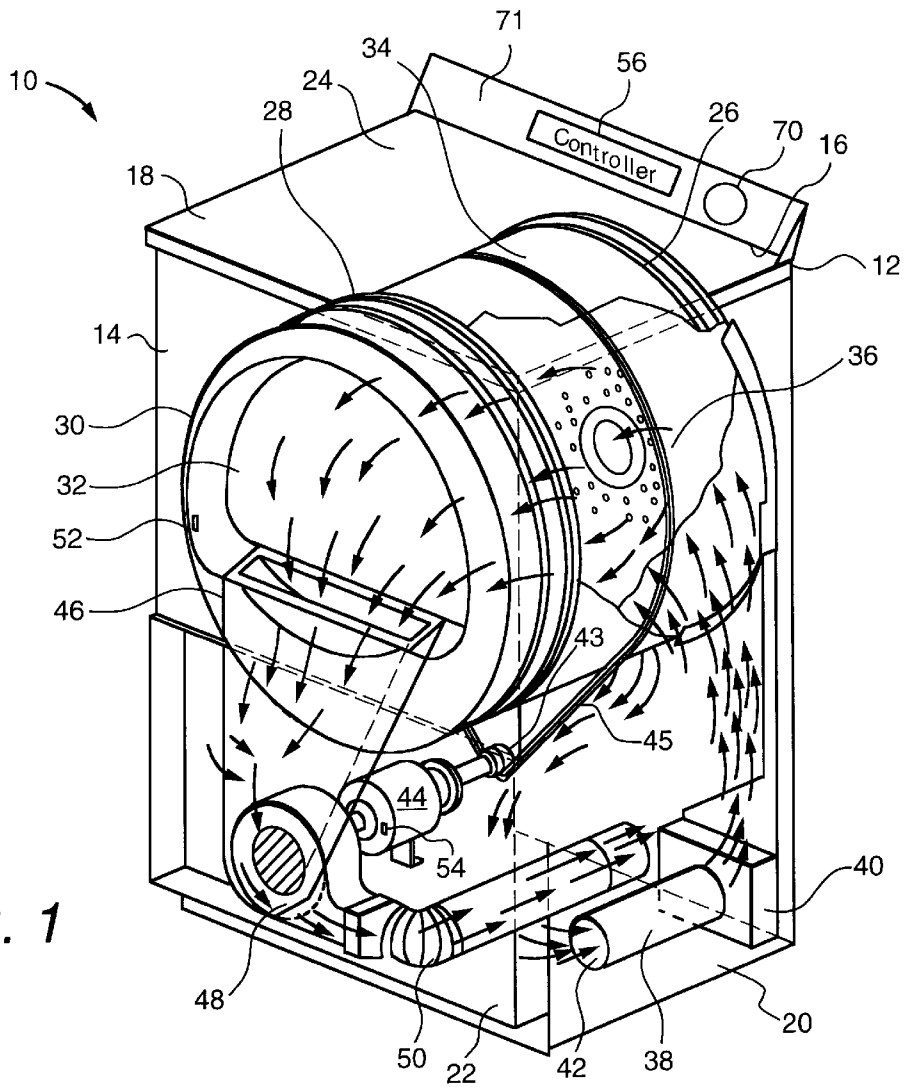
FIG. 1 shows a perspective view of a clothes dryer used in a first embodiment of this invention.

FIG. 1 shows a perspective view of a clothes dryer 10 used in a first embodiment of this invention. The clothes dryer includes a cabinet or a main housing 12 having a front panel 14, a rear panel 16, a pair of side panels 18 and 20 spaced apart from each other by the front and rear panels, a bottom panel 22, and a top cover 24. Within the housing 12 is a drum or container 26 mounted for rotation around a substantially horizontal axis. A motor 44 rotates the drum 26 about the horizontal axis through a pulley 43 and a belt 45. The drum 26 is generally cylindrical in shape, having an imperforate outer cylindrical wall 28 and a front flange or wall 30 defining an opening 32 to the drum. Clothing articles and other fabrics are loaded into the drum 26 through the opening 32. A plurality of tumbling ribs(not shown) are provided within the drum 26 to lift the articles and then allow them to tumble back to the bottom of the drum as the drum rotates. The drum 26 includes a rear wall 34 rotatably supported within the main housing 12 by a suitable fixed bearing. The rear wall 34 includes a plurality of holes 36 that receive hot air that has been heated by a heater such as a combustion chamber 38 and a rear duct 40. The combustion chamber 38 receives ambient air via an inlet 42. Although the clothes dryer 10 shown in FIG. 1 is a gas driver, it could just as well be an electric dryer without the combustion chamber 38 and the rear duct 40. The heated air is drawn from the drum 26 by a blower fan 48 which is also driven by the motor 44. The air passes through a screen filter 46 which traps any lint particles. As the air passes through the screen filter 46, it enters a trap duct seal (permagum) and is passed out of the clothes dryer through an exhaust duct 50. After the clothing articles have been dried, they are removed from the drum 26 via the opening 32.

In this embodiment the dryness of the clothing articles in the clothes dryer 10 is sensed by using a temperature sensor 52 and a phase angle sensor 54. The temperature sensor 52 senses the temperature of the heated air passing through the screen filter 46 and the phase angle sensor 54 senses the phase angle of the motor 44 as the drum 26 is rotated. The temperature sensor may be a commercially available sensor such as an Omega thermocouple type K and the phase angle sensor 54 may be a general purpose single phase induction motor sensor. The temperature sensor 52 and the phase angle sensor 54 provide signal representations of the temperature of the heated air and the phase angle of the motor, respectively, to a controller 56. The controller 56 is responsive to both the temperature sensor 52 and the phase angle sensor 54 and determines the dryness of the clothing articles in the drum as a function of the heated air temperature and the motor phase angle.

The controller 56 determines dryness by deciding when the percentage of water content in the clothing articles reaches a predefined level of water content. The percentage of water content is defined as:

$$\%\ \text{Water Content} = \frac{\text{Weight of Water}}{\text{Weight of Water} + \text{Weight of Articles}} \times 100 \quad (1)$$

In this invention, the percentage of water content is divided into five categories which are classified as wet, less dry, normal, dry, and bone dry. The ranges of percentage of water content for the classifications are 100% to about 16% for the wet classification, about 16% to about 10% for the less dry classification, about 10% to about 5% for the normal classification, about 5% to about 3% for the dry classification, and about 3% to 0% for the bone dry classification. In this embodiment, the controller 56 determines dryness by deciding when the percentage of water content in the clothing articles is in the range of about 10% to about 3% water content, with the preferred range being from about 5% to about 3%. The steps performed by the controller 56 to determine dryness are described below in more detail. Once the controller 56 has determined that the clothing articles are dry, then the controller terminates the drying cycle. An advantage of the present invention over the open control loop dryer is that energy consumption is reduced and there is less potential for damage to the articles due to overheating, since the dryness is automatically detected.

Figure 2:
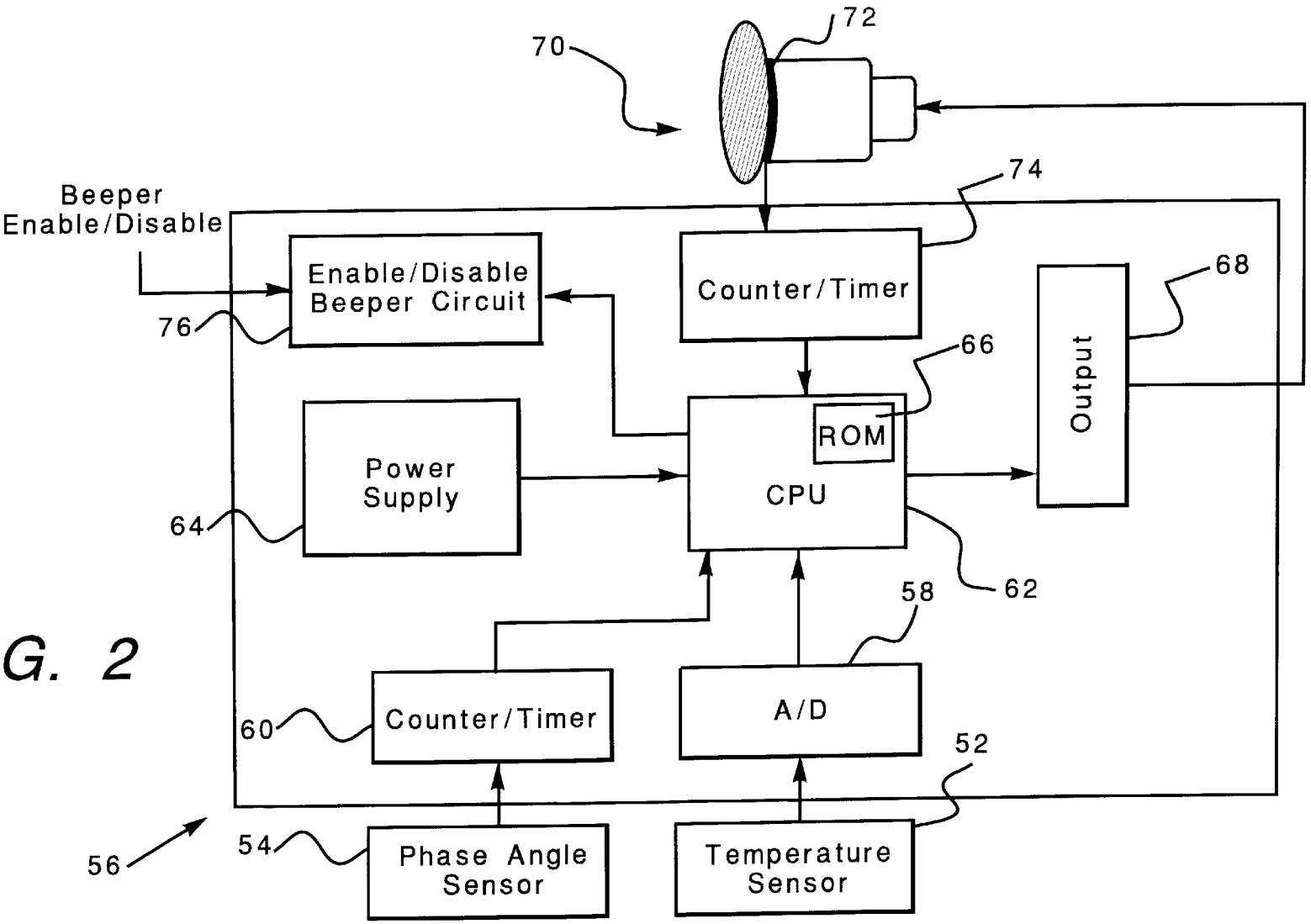
FIG. 2 shows a block diagram of a controller used in the first embodiment of this invention.

A more detailed view of the controller 56 according to the first embodiment of this invention is shown in FIG. 2. The controller comprises an analog to digital (A/D) converter 58 for receiving the signal representations sent from the temperature sensor 52 and a counter/timer 60 for receiving the signal representations sent from the phase angle sensor. The signal representations from the A/D converter 58 and the counter/timer 60 are sent to a central processing unit (CPU) 62 for further signal processing. It is also within the scope of this invention to use the clock within the CPU 62 for directly receiving the signal representations from the phase angle sensor 54 instead of the counter/timer 60. The CPU which receives power from a power supply 64 comprises decision logic stored in a read only memory (ROM) 64 for determining the dryness of the clothing articles in the container as a function of the processed signal representations of the heated air temperature and the motor phase angle. The decision logic used to determine dryness is described below in more detail. Once it has been determined that the clothing articles are dry, then the CPU 62 sends a signal to an output circuit 68 which sends a signal to shut off a cycle selector knob 70 located on a control panel 71 of the dryer 10. The position of the selector knob 70 is monitored by a position encoder 72 which sends signals to a counter/timer 74 which is connected to the CPU 62. As the drying cycle is shut off the controller activates a beeper via an enable/disable and beeper circuit 76 to indicate the end of the cycle.

In this embodiment, dryness is based on a correlation between the signal representations of the motor phase angle and the temperature of the heated air. A problem associated with other dryers that only use a motor phase angle to sense dryness is that the conclusions regarding the dryness can be misleading. In particular, as a drying cycle proceeds the clothing articles lose weight continuously because there is less water in the articles. As the clothing articles lose weight the motor phase peak to peak values increase. When these values stop increasing then one can deduce that the clothing articles are already dry, albeit over. Furthermore, the phase angle sensor values are usually noisy and may result in misleading dryness conclusions. This invention has overcome the problems associated with using a motor phase angle sensor by correlating the phase angle signal representations with the signal representations generated from the temperature sensor.

Figure 3A:
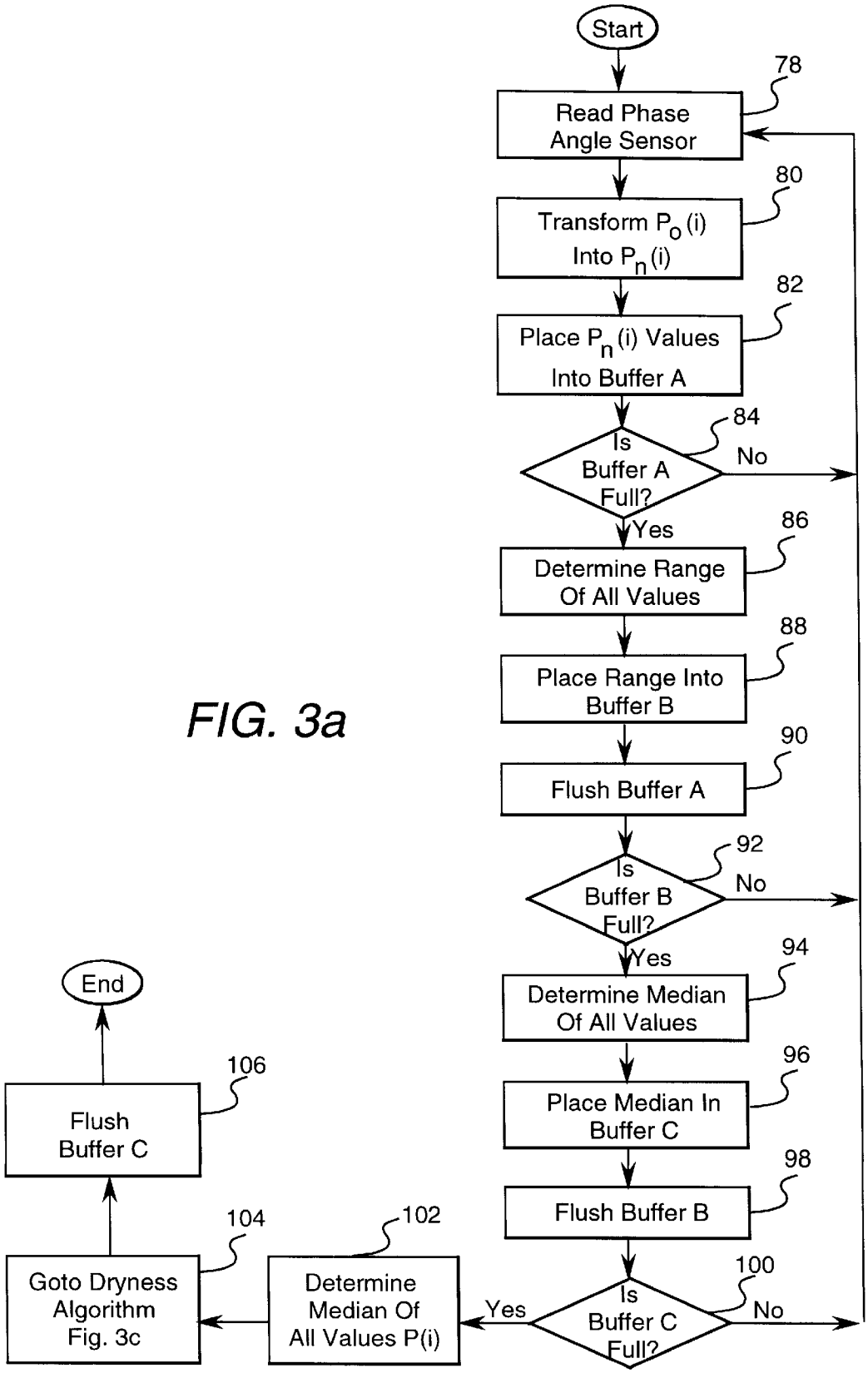
FIGS. 3*a*–3*c* show a flow chart setting forth the steps used to determine the dryness of the clothing articles used in the first embodiment of this invention.
Figure 3B:
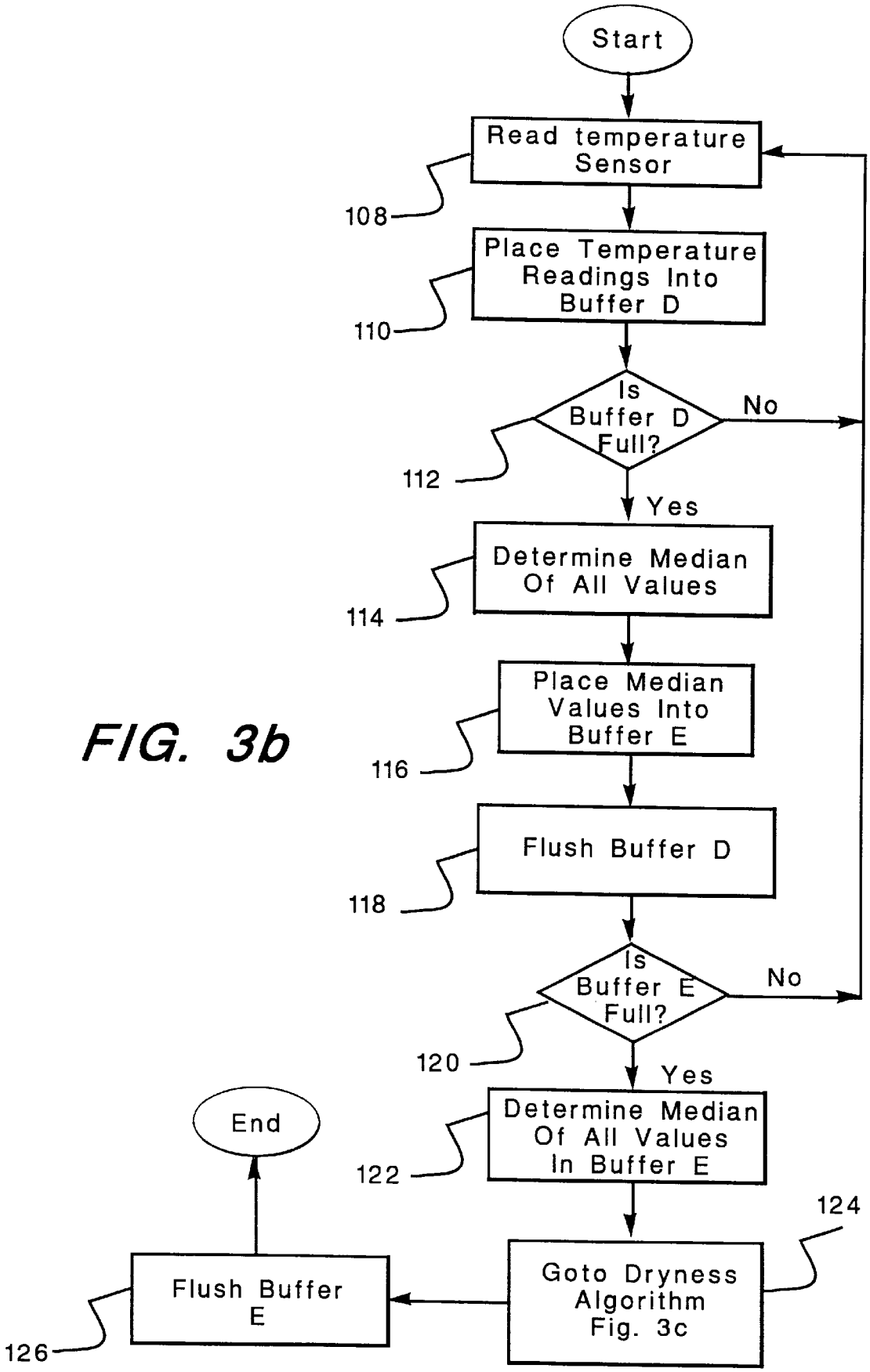
Figure 3C:
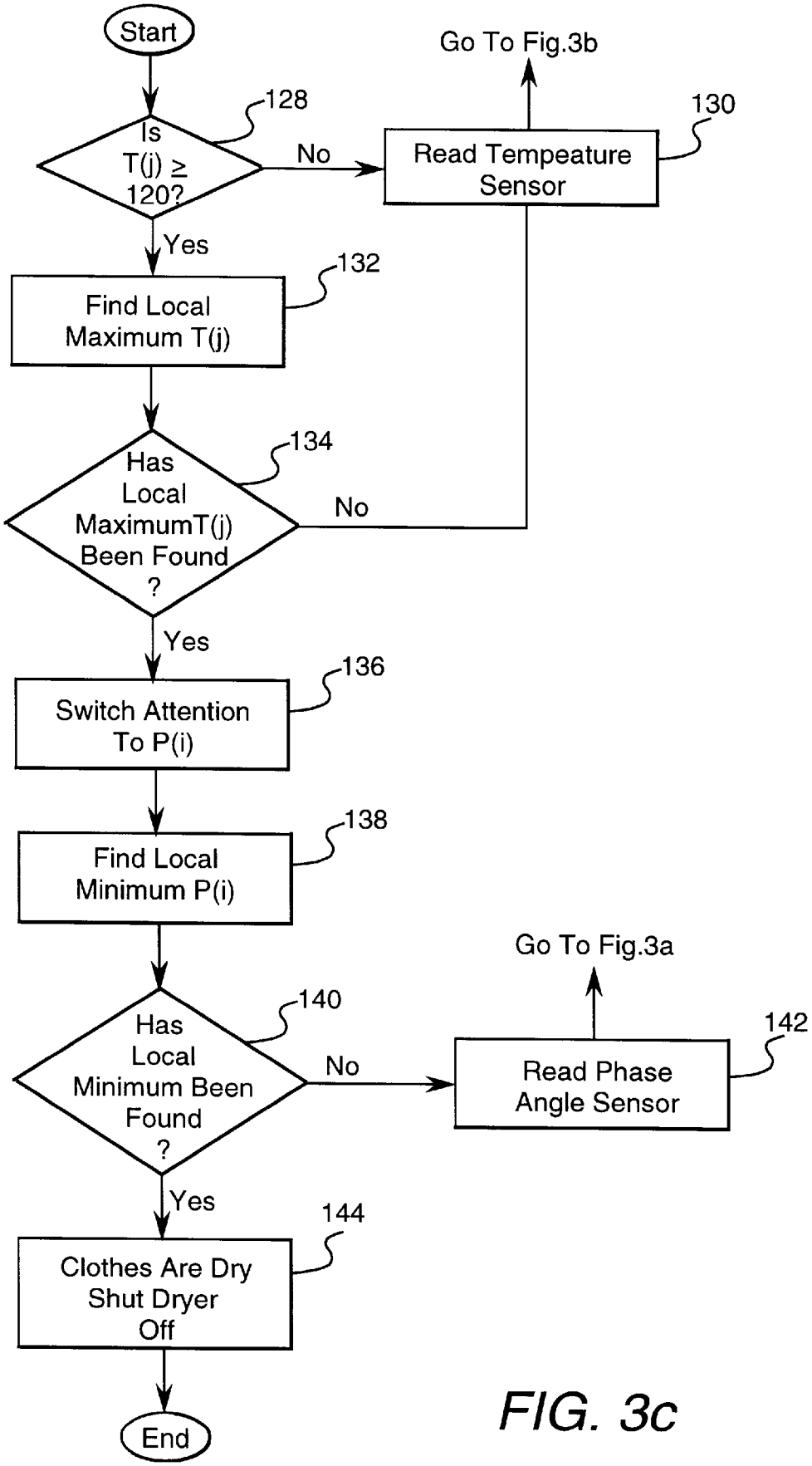

FIGS. 3*a*–3*c* disclose flow charts setting forth the steps used to determine the dryness of the clothing articles according to the first embodiment of this invention. FIGS. 3*a*–3*b* disclose the signal processing steps performed on the signal representations generated from the phase angle sensor and the temperature sensor, respectively. The signal processing steps disclosed in both FIGS. 3*a*–3*b* are performed in parallel in real time. In this invention, the motor phase angle signal representations are logged to the CPU 62 at a sampling rate of 10 Hz, while the temperature signal representations are logged to the CPU at a sampling rate of 1 Hz. In this embodiment, the CPU 62 has five buffers A, B, C, D, and E reserved therein. Buffers A, B, and C are reserved for the phase angle signal representations, while buffers D and E are reserved for the temperature signal representations. Buffer A is capable of storing 14 data points, while Buffers B and C are capable of storing 32 and 4 data points, respectively. For the temperature signal processing, Buffer D is capable of storing 16 data points, while Buffer E is capable of storing 4 data points.

Referring now to FIG. 3*a* the signal processing steps of the phase angle signal representations will be described. The signal processing begins at 78 where the phase angle sensor is read. The phase angle signal is denoted as $P_0(i)$ where i denotes its time sampling sequence. The phase angle signal $P_0(i)$ is transformed into a relative phase angle $P_n(i)$ at 80 wherein $P_n(i)$ equals $90°-P_0(i)$. The $P_n(i)$ data value is placed in Buffer A at 82. One by one the $P_n(i)$ data values are placed into Buffer A until it has been determined that the buffer is full at 84. When Buffer A is full, the range of all values stored in the buffer is calculated at 86 and placed into Buffer B at 88 and then Buffer A is flushed at 90. If Buffer B is not full at 92, then the phase angle sensor is read again and steps 80–90 are repeated until Buffer B is full. When Buffer B is full, the median of all values stored in Buffer B is calculated at 94 and placed into Buffer C at 96 and then Buffer B is flushed at 98. If Buffer C is not full at 100, then the phase angle sensor is read again and steps 80–98 are repeated until Buffer C is full. When Buffer C is full, the median of all values stored in Buffer C is calculated at 102. Once the median of all values stored in Buffer C has been calculated then the median value $P_n(i)$ is passed at 104 to the dryness algorithm described below in FIG. 3*c* and Buffer C is flushed at 106. This process is repeated until the end of the drying cycle.

As mentioned above the signal processing steps for the phase angle and temperature signal representations are performed in parallel in real time. Referring now to FIG. 3*b* the signal processing steps of the temperature signal representations will be described. The signal processing of the temperature begins at 108 where the temperature sensor is read. The temperature signal is denoted as T(j) where j denotes its time sampling sequence. The T(j) data value is placed in Buffer D at 110. One by one the T(j) data values are placed into Buffer D until it has been determined that the buffer is full at 112. When Buffer D is full, the median of all values stored in the buffer is calculated at 114 and placed into Buffer E at 116 and then Buffer D is flushed at 118. If Buffer E is not full at 120, then the temperature sensor is read again and steps 110–118 are repeated until Buffer E is full. When Buffer E is full, the median of all values stored in Buffer E is calculated at 122. Once the median of all values stored in Buffer E has been calculated then the median value T(j) is passed at 124 to the dryness algorithm described in FIG. 3*c* and Buffer E is flushed at 126. This process is repeated until the end of the drying cycle.

Once the signal processing steps for the phase angle and temperature signal representations have been performed the dryness algorithm set forth in FIG. 3*c* is then initiated. Referring now to FIG. 3*c* the dryness algorithm will be described. The dryness detection begins at 128 where T(j) is monitored to determine if its value exceeds 120° F. (49° C.). If the T(j) value does not exceed 120° F. (49° C.), then FIG. 3*b* is initiated at 130 and the temperature sensor is read and steps 110–126 are repeated until T(j) exceeds 120° F. Once T(j) has exceeded 120° F. (49° C.) then T(j) is examined at 132 to find the local maximum. In the present invention, the local maximum is found if $T(j) \leqq T(j-1)$ and $T(j-1) \geqq T(j-2)$. If the local maximum of T(j) has not been found at 134, then FIG. 3*b* is initiated again at 130 and the temperature sensor is read and steps 110–126 are repeated until the local maximum is found. Once the local maximum has been found then the dryness algorithm switches attention to the phase angle $P_n(i)$ at 136. The phase angle $P_n(i)$ value is then examined at 138 to find the local minimum. In the present invention, the local minimum is found if $P(i) \geqq P(i-1)$ and $P(i-1) \leqq P(i-2)$. If the local minimum of $P_n(i)$ has not been found at 140, then FIG. 3*a* is initiated again at 142 and the phase angle sensor is read and steps 80–106 are repeated until the local minimum is found. Once the local minimum has been found then the clothing articles are considered dry and the dryer is shut off at 144. In essence, dryness is sensed by determining when the signal representations of the heated air temperature have reached a local maximum and the signal representations of the motor phase angle have reached a local minimum.

Figures 4A, 4B, 4C:
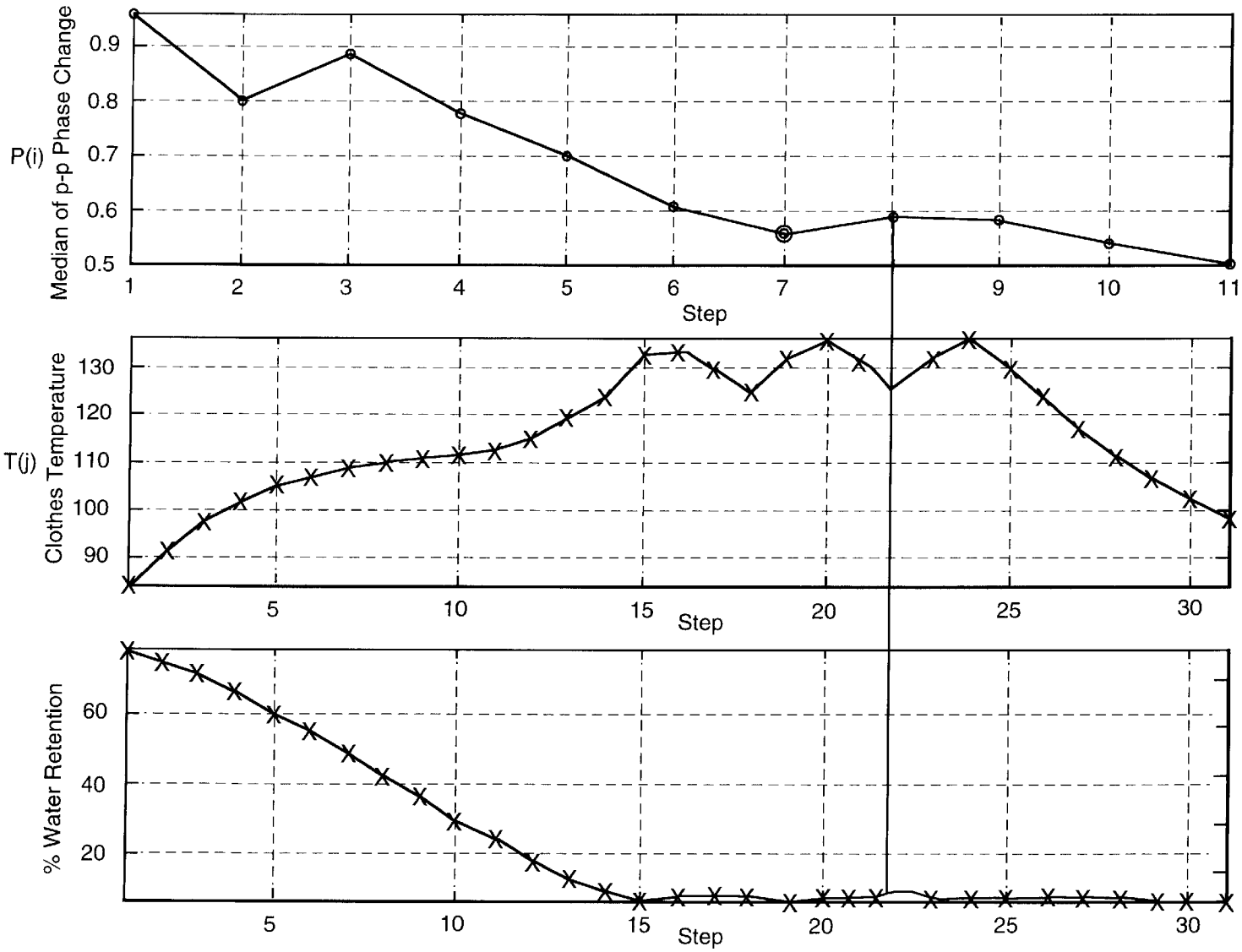
FIGS. 4*a*–4*c* are time series plots illustrating the operation of the clothes dryer set forth in the first embodiment of this invention.

FIGS. 4*a*–4*c* are time series plots illustrating the operation of the clothes dryer set forth in the first embodiment according to this invention. FIG. 4*a* is a plot of the phase angle P(i) versus i, the time sampling sequence. More specifically, FIG. 4*a* shows the median of peak to peak phase change over sampling time steps for a particular drying cycle. FIG. 4*b* is a plot of the temperature T(j) versus j, the sampling time steps. FIG. 4*c* is a plot of the percentage of water content versus the sampling time step. In the example illustrated in FIGS. 4*a*–4*c*, the above described dryness detection algorithm does not begin until the clothes temperature T(j) exceeds 120° F. (49° C.). The first local maximum that is found occurs at time step 17 of FIG. 4*b*. At this time the dryness detection algorithm then searches for the first local minimum of P(i) in FIG. 4*a*. In this example, the first local minimum of P(i) occurs at time step 7 of FIG. 4*a*. Then the dryness detection algorithm will issue a shut-off command at the next time step (i.e. time step 8) in FIG. 4*a*. At this time the water content in the clothing articles is almost at its lowest value as shown in FIG. 4*c*. Note that the percentage of water content in the clothing articles is well within the range of about 10% to about 3% water content and within the preferred range from about 5% to about 3%. As mentioned above this invention prevents the clothing articles from being over-heated or under-heated and reduces energy consumption.

Figure 5:
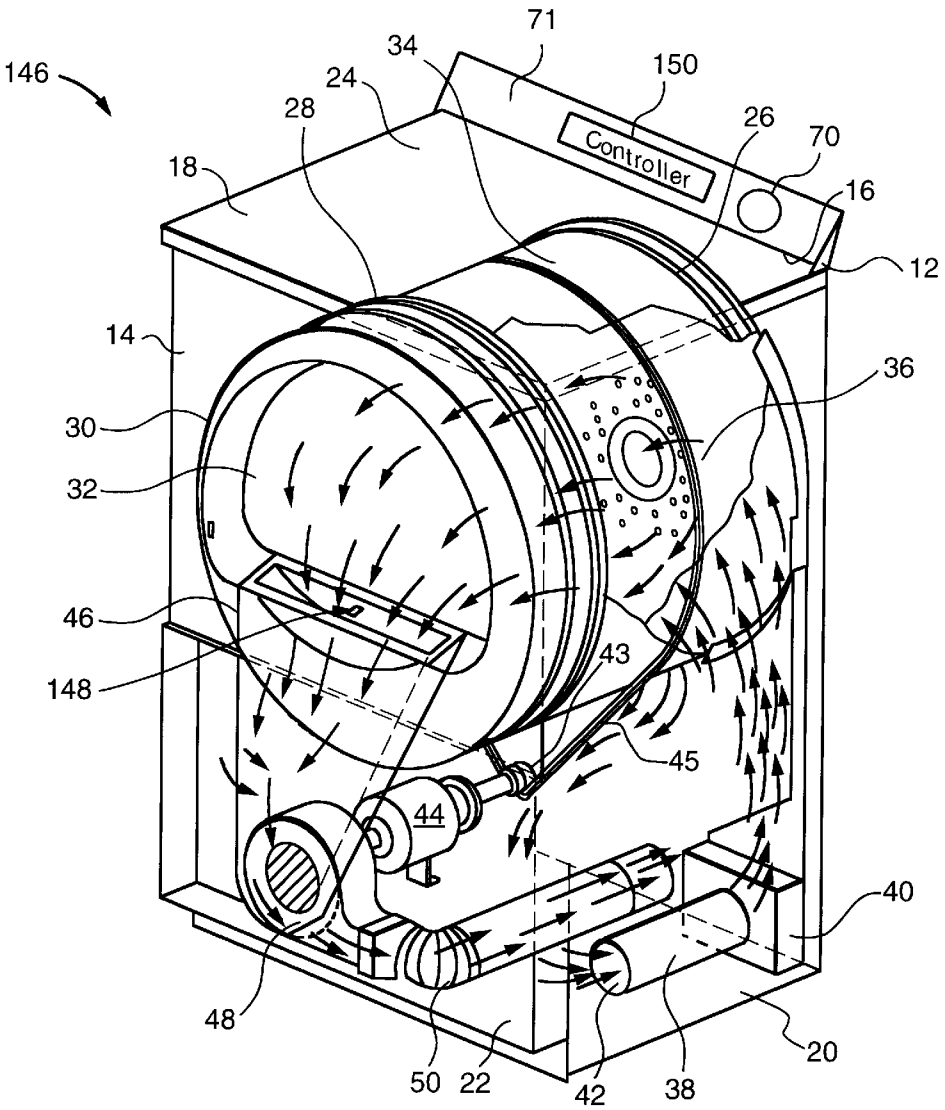
FIG. 5 shows a perspective view of a clothes dryer according to a second embodiment of this invention.

FIG. 5 shows a perspective view of a clothes dryer 146 according to a second embodiment of this invention. The clothes dryer 146 is similar to the clothes dryer of the first embodiment except that there is neither a temperature sensor nor a motor phase angle sensor in this embodiment. Instead this embodiment uses a humidity sensor 148 for detecting the dryness of the clothing articles. The humidity sensor 148 senses the humidity of the heated air passing through the exhaust duct 50. The humidity sensor may be a commercial off-the shelf item such as a Parametrics HT-119. The humidity sensor 148 provides signal representations of the humidity of the heated air to a controller 150. The controller 150 is responsive to the humidity sensor 148 and determines the dryness of the clothing articles in the drum as a function of the humidity of the heated air in the exhaust duct 50.

Figure 6:
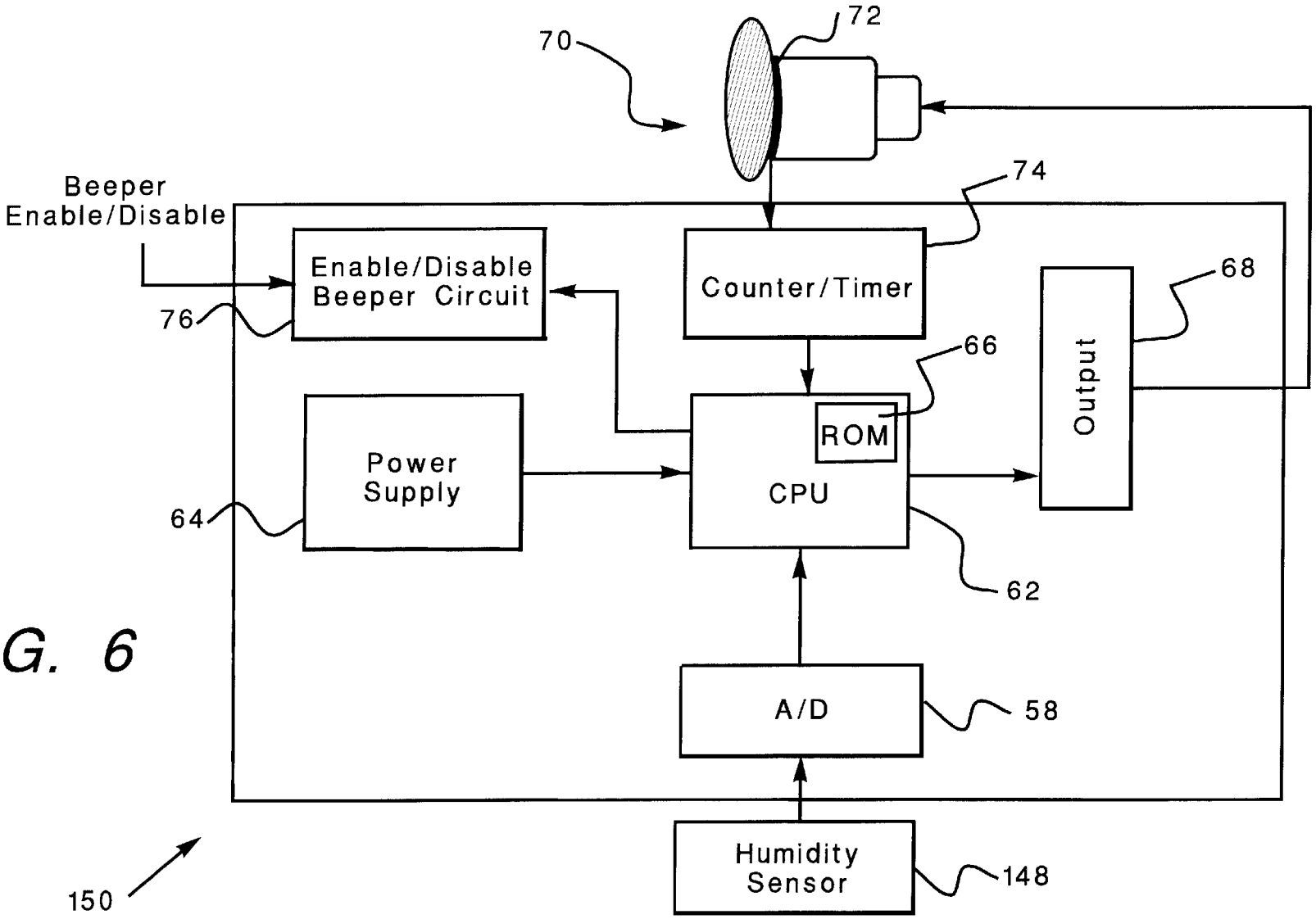
FIG. 6 shows a block diagram of a controller used in the second embodiment of this invention.

A more detailed view of the controller 150 according to the second embodiment of this invention is shown in FIG. 6. The controller in this embodiment is similar to the controller set forth in the first embodiment except that the counter/timer for receiving the signal representations sent from the phase angle sensor has been removed. In this embodiment an A/D converter receives the signal representations sent from the humidity sensor 148. The CPU comprises decision logic stored in a ROM for determining the dryness of the clothing articles in the container as a function of the processed signal representations of the humidity of the heated air. A problem associated with other dryers that use humidity to sense dryness is that the typical humidity sensors that are used are quite expensive. The present invention can overcome the cost problems by using a low-end humidity sensor that has a relative humidity range from about 0% to about 30% with a dryness detection algorithm which is described below in more detail.

Figure 7:
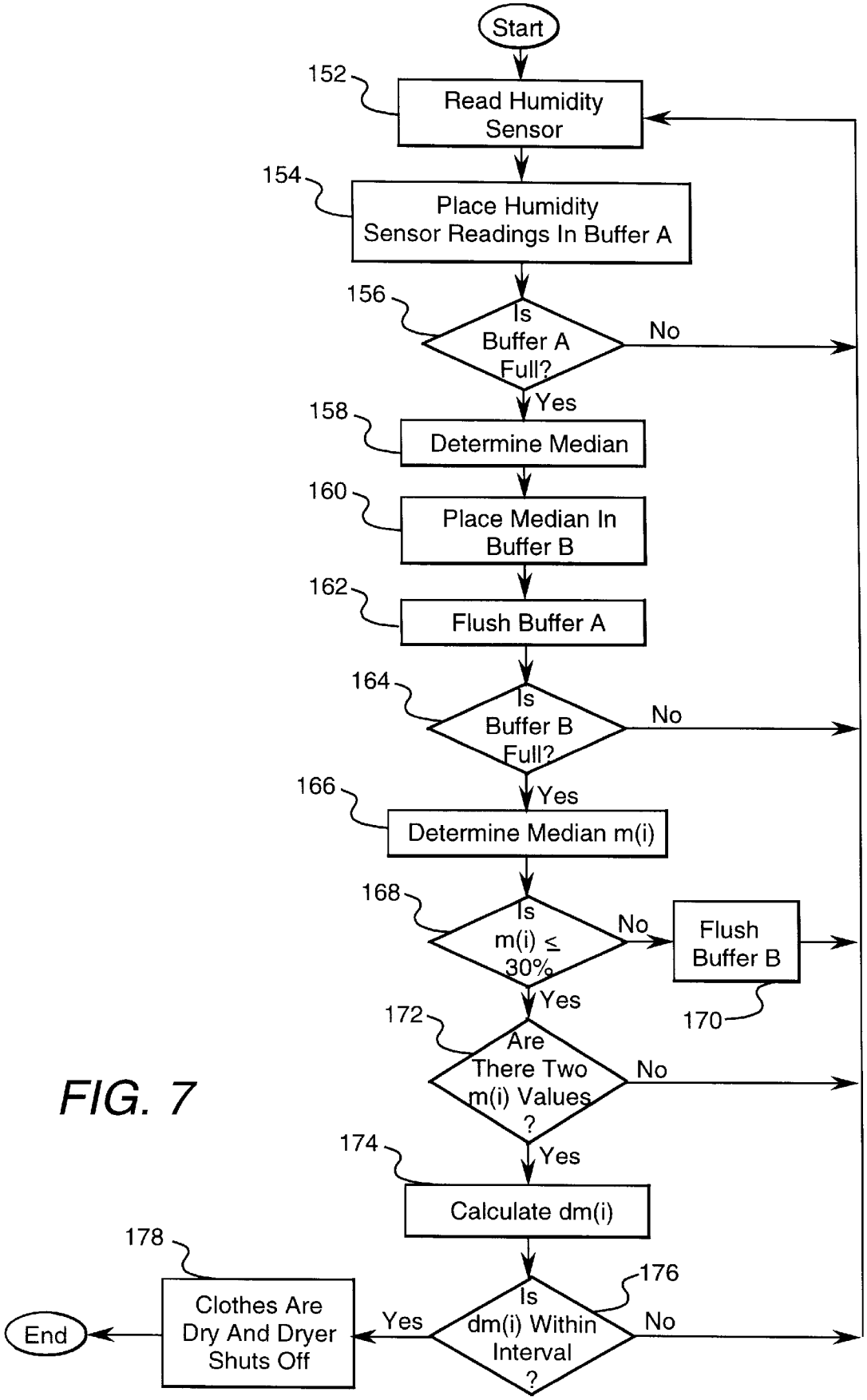
FIG. 7 shows a flow chart setting forth the steps used to determine the dryness of the clothing articles according to the second embodiment of this invention.

FIG. 7 discloses a flow chart setting forth the steps used to determine the dryness of the clothing articles according to the second embodiment of this invention. In this embodiment, the humidity signal representations are logged to the CPU at a sampling rate of 1 Hz and the CPU has two buffers A and B reserved therein. Buffer A is capable of storing 16 data points, while Buffers B is capable of storing 4 data points. The signal processing begins at 152 where the humidity sensor is read. The humidity signal is denoted as m(i) where i denotes its time sampling sequence. The m(i) data value is placed in Buffer A at 154. One by one the m(i) data values are placed into Buffer A until it has been determined that the buffer is full at 156. When Buffer A is full, the median of all values stored in the buffer is calculated at 158 and placed into Buffer B at 160 and then Buffer A is flushed at 162. If Buffer B is not full at 164, then the humidity sensor is read again and steps 154–162 are repeated until Buffer B is full. When Buffer B is full, the median of all values stored in Buffer B is calculated at 166.

Once the median of all values has been calculated then the median value m(i) is passed to step 168 where the beginning of the dryness detection is initiated.

The m(i) data value is now monitored to determine if its value is less than 30%. If the m(i) value exceeds 30%, then Buffer B is flushed at 170 and the humidity sensor is read again and steps 154–166 are repeated until m(i) is less than 30%. Once m(i) is less than 30% then m(i) is examined at 172 to determine if there are more than two m(i) data values. If there are not more than two m(i) data values then the humidity sensor is read again and steps 154–168 are repeated until there are more than two m(i) data values. Once there are more than two m(i) data values then the difference or derivative in humidity dm(i) is determined at 174. In this invention, the difference in humidity dm(i) equals m(i)-m(i−1). At step 176, the dryness algorithm determines whether the difference in humidity dm(i) is the same value for a predetermined interval. In this embodiment, the preferred predetermined interval is three consecutive values that are within a tolerable small band or range. This relationship is described below in equation 2:

$$dm(i-2)\epsilon[-3,3] \text{ and } dm(i-1)\epsilon[-3,3] \text{ and } dm(i)\epsilon[-3,3] \quad (2)$$

Once it has been determined that there are three consecutive values within the tolerable small band [−3,3] as defined in equation 2, then the clothing articles are considered dry and the dryer is shut off at 178.

Figure 8A:
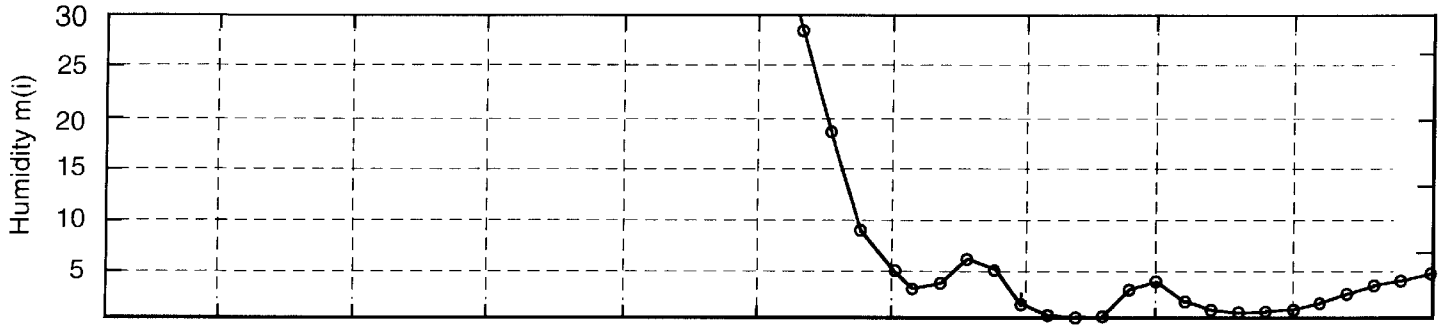
FIGS. 8*a*–8*c* are time series plots illustrating the operation of the clothes dryer set forth in the second embodiment of this invention.
Figure 8B:
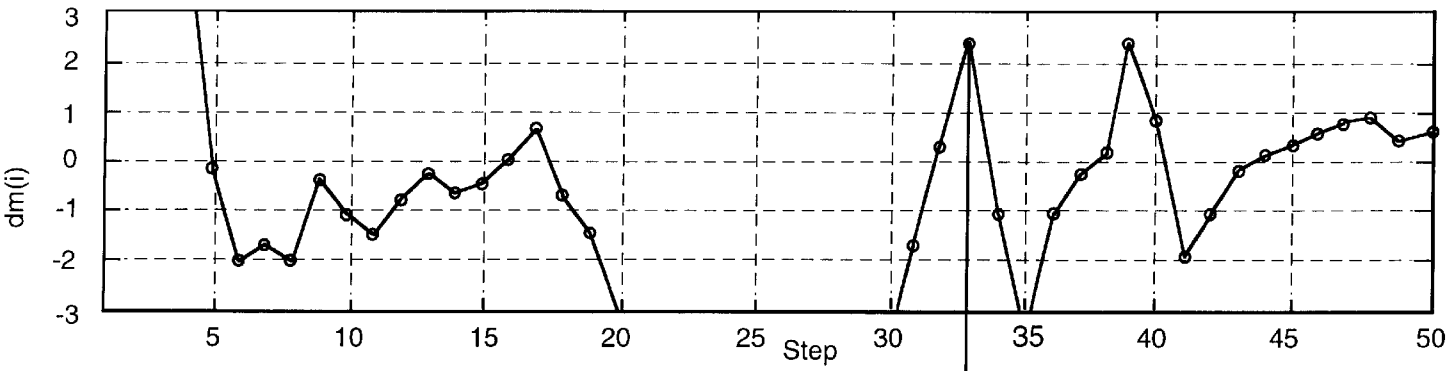
Figure 8C:
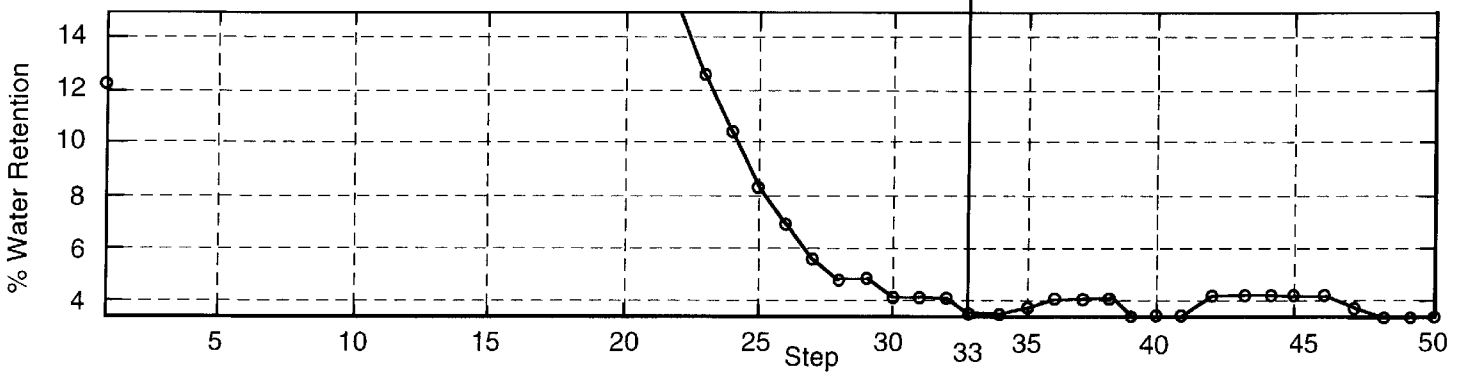

FIGS. 8*a*–8*c* are time series plots illustrating the operation of the clothes dryer set forth in the second embodiment according to this invention. FIG. 8*a* is a plot of the humidity m(i) versus i, the time sampling sequence. Note that the scale of the y-axis in FIG. 8*a* ranges from 0% to 30%. FIG. 8*b* is a plot of the difference of the humidity signal dm(i) versus i, the sampling time steps. Note that the scale of the y-axis in FIG. 8*b* ranges in the band from −3 to 3. FIG. 8*c* is a plot of the percentage of water content versus the sampling time step. In the example illustrated in FIGS. 8*a*–8*c*, the above described dryness detection algorithm detects that there are three consecutive difference in humidity dm(i) values starting after the 30th time step. The dryness detection algorithm then issues a shut-off command at time step 33 where the third consecutive value has been noted. At this time the water content in the clothing articles is stabilized and is almost at its lowest value as shown in FIG. 8*c*. Note that the percentage of water content in the clothing articles is well within the range of about 10% to about 3% water content and within the preferred range from about 5% to about 3%. As mentioned above this invention prevents the clothing articles from being over-heated or under-heated and reduces energy consumption.

Figure 9:
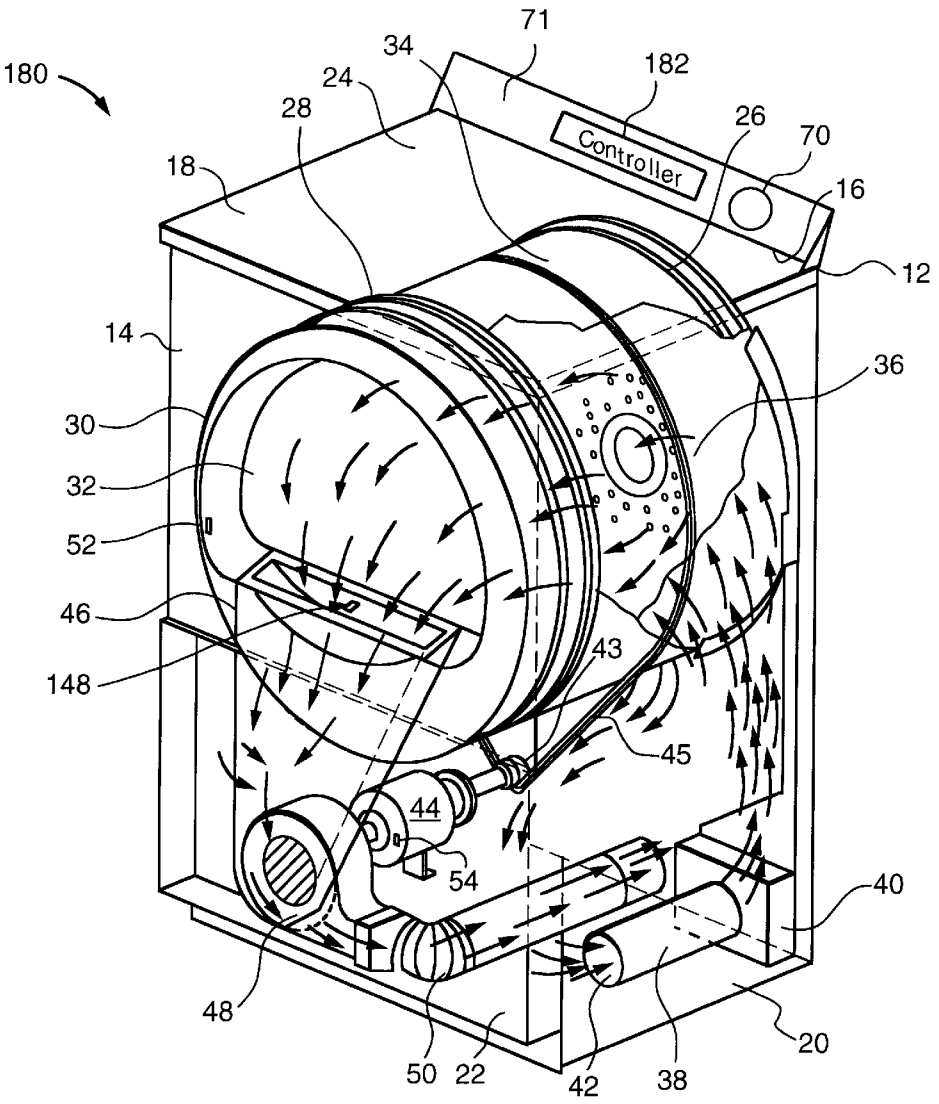
FIG. 9 shows a perspective view of a clothes dryer according to a third embodiment of this invention.

FIG. 9 shows a perspective view of a clothes dryer 180 according to a third embodiment of this invention. The clothes dryer 180 is similar to the clothes dryer shown in the first and second embodiment except that in this embodiment there is a temperature sensor 52, a motor phase angle sensor 54, and a humidity sensor 148 that are all used for detecting the dryness of the clothing articles. The temperature sensor 52, the motor phase angle sensor 54, and the humidity sensor 148 provide signal representations of the temperature of the heated air, the phase angle of the motor, and the humidity of the heated air to a controller 182, respectively. The controller 182 is responsive to the temperature sensor 52, the phase angle sensor 54, and the humidity sensor 148 and determines the dryness of the clothing articles in the drum as a function of the temperature of the heated air, the motor phase angle, and the humidity of the heated air.

Figure 10:
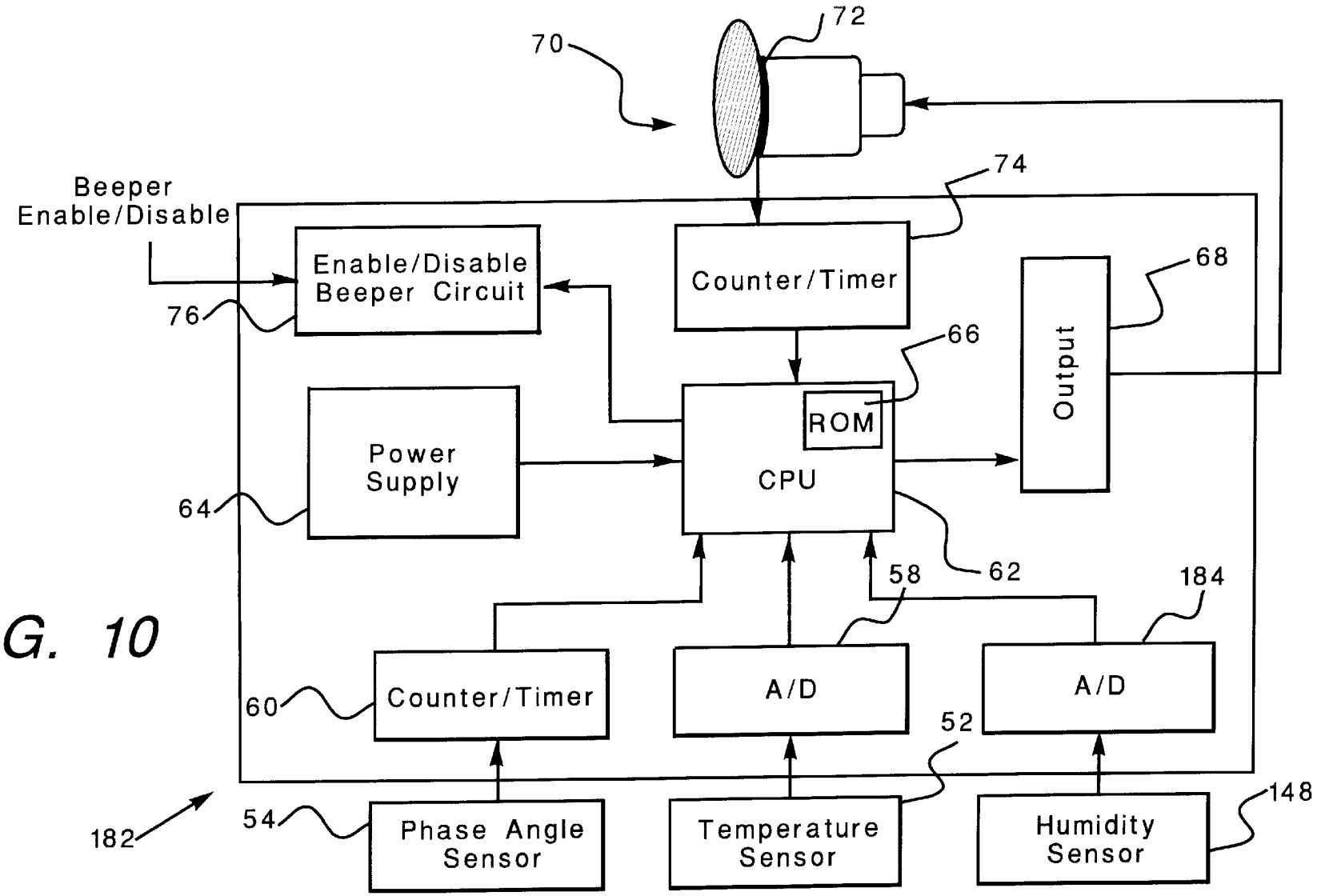
FIG. 10 shows a block diagram of a controller used in the third embodiment of this invention.

A more detailed view of the controller 182 according to the third embodiment of this invention is shown in FIG. 10. The controller in this embodiment is similar to the controllers set forth in the first and second embodiment except that there is a counter/timer 60 for receiving the signal representations sent from the phase angle sensor 54, an A/D converter 58 for receiving the signal representations sent from the temperature sensor 52, and an A/D converter 184 for receiving the signal representations sent from the humidity sensor 148. The CPU comprises decision logic stored in ROM for determining the dryness of the clothing articles in the container as a function of the processed signal representations of the motor phase angle, the temperature of the heated air, and the humidity of the heated air. The decision logic contains the aforementioned dryness algorithms set forth in FIGS. 3*a*–3*c* and FIG. 7. Accordingly, the controller determines the dryness of the clothing articles following the steps set forth in the two aforementioned algorithms. More specifically, if and only if the two algorithms are in agreement, then the clothes dryer shuts off. Like the first and second embodiment, the third embodiment provides another method for detecting the dryness of the clothing articles and that prevents the articles from being over-heated or under-heated and reduces energy consumption. It is therefore apparent that there has been provided in accordance with the present invention, a system and method for sensing the dryness of articles in an appliance that fully satisfy the aims and advantages and objectives hereinbefore set forth. The invention has been described with reference to several embodiments, however, it will be appreciated that variations and modifications can be effected by a person of ordinary skill in the art without departing from the scope of the invention.

What is claimed is:

1. An appliance for drying clothing articles, comprising:

a container for receiving the clothing articles;

a motor for rotating the container about an axis;

a heater for supplying heated air to the container;

a duct for directing the heated air outside the container;

a temperature sensor for sensing the heated air and providing signal representations thereof;

a phase angle sensor for sensing motor phase angle and providing signal representations thereof; and a controller responsive to both the temperature sensor and the phase angle sensor for determining the dryness of the clothing articles in the container as a function of the heated air temperature and the motor phase angle, the controller comprising a signal processing unit for processing the signal representations of the heated air temperature and the motor phase angle and a decision logic unit for determining the dryness of the clothing articles in the container as a function of the processed signal representations of the heated air temperature and the motor phase angle, wherein the decision logic unit decides whether the processed signal representations of the heated air temperature have reached a local maximum and the processed signal representations of the motor phase angle have reached a local minimum.

2. The appliance according to claim 1, wherein the controller further comprises a disable unit for terminating the drying cycle of the appliance when the local maximum and local minimum have been reached.

3. The appliance according to claim 1, wherein the controller comprises a disable unit for terminating the drying cycle of the appliance.

4. The appliance according to claim 1, wherein the controller uses the signal representations of the heated air temperature and the motor phase angle to determine whether a percentage of water content in the clothing articles has reached a predefined level.

5. The appliance according to claim 4, wherein the controller comprises a disable unit for terminating the drying cycle of the appliance as the percentage of water content in the clothing articles reaches the predefined level.

6. The appliance according to claim 4, wherein the predefined level of percentage of water content ranges from about 10% water content to about 3% water content.

7. A clothes dryer, comprising:

a container for accommodating a plurality of clothing articles;

a motor for rotating the container about an axis;

a heater for supplying heated air to the container;

a duct for directing the heated air outside the container;

a temperature sensor for sensing the heated air and providing signal representations thereof;

a phase angle sensor for sensing motor phase angle and providing signal representations thereof; and a controller responsive to both the temperature sensor and the phase angle sensor for determining the dryness of the plurality of clothing articles in the container as a function of the heated air temperature and the motor phase angle, the controller comprising a signal processing unit for processing the signal representations of the heated air temperature and the motor phase angle and a decision logic unit for determining the dryness of the clothing articles in the container as a function of the processed signal representations of the heated air temperature and the motor phase angle, wherein the decision logic unit decides whether the processed signal representations of the heated air temperature have reached a local maximum and the processed signal representations of the motor phase angle have reached a local minimum.

8. The clothes dryer according to claim 7, wherein the controller further comprises a disable unit for terminating the drying cycle of the appliance when the local maximum and local minimum have been reached.

9. The clothes dryer according to claim 7, wherein the controller comprises a disable unit for terminating the drying cycle of the clothes dryer.

10. The clothes dryer according to claim 7, wherein the controller uses the signal representations of the heated air temperature and the motor phase angle to determine whether a percentage of water content in the plurality of clothing articles has reached a predefined level.

11. The clothes dryer according to claim 10, wherein the controller comprises a disable unit for terminating the drying cycle of the appliance as the percentage of water content in the clothing articles reaches the predefined level.

12. The clothes dryer according to claim 10, wherein the predefined level of percentage of water content ranges from about 10% water content to about 3% water content.

13. A method for drying clothing articles, comprising the steps of:

providing a container for receiving the clothing articles;

rotating the container about an axis with a motor;

supplying heated air to the container;

directing the heated air outside the container;

sensing temperature of the heated air and providing signal representations thereof;

sensing motor phase angle and providing signal representations thereof; and determining the dryness of the clothing articles in the container as a function of the heated air temperature and the motor phase angle, wherein the determining dryness comprises deciding whether the signal representations of the heated air temperature have reached a local maximum and the signal representations of the motor phase angle have reached a local minimum.

14. The method according to claim 13, further comprising the step of terminating the drying cycle when the local maximum and local minimum have been reached.

15. The method according to claim 13, wherein the step of determining dryness comprises determining whether a percentage of water content in the clothing articles has reached a predefined level.

16. The method according to claim 15, further comprising the step of terminating the drying cycle as the percentage of water content in the clothing articles reaches the predefined level.

17. The method according to claim 15, wherein the predefined level of percentage of water content ranges from about 10% water content to about 3% water content.

18. An appliance for drying clothing articles, comprising:

a container for receiving the clothing articles;

a heater for supplying heated air to the container;

a duct for directing the heated air outside the container;

a humidity sensor for sensing the humidity of the heated air entering the duct and providing signal representations thereof; and a controller responsive to the humidity sensor for determining the dryness of the clothing articles in the container as a function of the humidity of the heated air, the clothing articles being dry when the humidity signal representations are within a predetermined humidity range and when consecutive difference values of the humidity signal representations are within a predetermined interval.

19. The appliance according to claim 18, wherein the controller comprises a signal processing unit for processing the signal representations of the humidity of the heated air.

20. The appliance according to claim 19, wherein the controller further comprises a decision logic unit for determining the dryness of the clothing articles in the container as a function of the processed signal representations of the humidity of the heated air.

21. The appliance according to claim 18, wherein the controller comprises a disable unit for terminating the drying cycle of the appliance.

22. The appliance according to claim 18, wherein the predetermined humidity range is from about 0% humidity to about 30% humidity.

23. The appliance according to claim 18, wherein the predetermined interval is three consecutive difference in humidity values that are within a tolerable band.

24. A clothes dryer, comprising:

a container for accommodating a plurality of clothing articles;

a heater for supplying heated air to the container;

a duct for directing the heated air outside the container;

a humidity sensor for sensing the humidity of the heated air entering the duct and providing signal representations thereof; and a controller responsive to the humidity sensor for determining the dryness of the plurality of clothing articles in the container as a function of the humidity of the heated air, the plurality of clothing articles being dry when the humidity signal representations are within a predetermined humidity range and when difference values of the humidity signal representations are within a predetermined interval.

25. The clothes dryer according to claim 24, wherein the controller comprises a signal processing unit for processing the signal representations of the humidity of the heated air.

26. The clothes dryer according to claim 25, wherein the controller further comprises a decision logic unit for determining the dryness of the plurality of clothing articles in the container as a function of the processed signal representations of the humidity of the heated air.

27. The clothes dryer according to claim 24, wherein the controller comprises a disable unit for terminating the drying cycle of the dryer.

28. The clothes dryer according to claim 24, wherein the predetermined humidity range is from about 0% humidity to about 30% humidity.

29. The clothes dryer according to claim 24, wherein the predetermined interval is three consecutive difference in humidity values that are within a tolerable band.

30. A method for drying clothing articles, comprising the steps of:

providing a container for receiving the clothing articles;

supplying heated air to the container;

directing the heated air outside the container with a duct;

sensing the humidity of the heated air entering the duct and providing signal representations thereof; and determining the dryness of the clothing articles in the container as a function of the humidity of the heated air, the clothing articles being dry when the humidity signal representations are within a predetermined humidity range and when difference values of the humidity signal representations are within a predetermined interval.

31. The method according to claim 30, further comprising the step of terminating the drying cycle.

32. The method according to claim 30, wherein the predetermined humidity range is from about 0% humidity to about 30% humidity.

33. The method according to claim 30, wherein the predetermined interval is three consecutive difference in humidity values that are within a tolerable band.

34. An appliance for drying clothing articles, comprising:

a container for receiving the clothing articles;

a motor for rotating the container about an axis;

a heater for supplying heated air to the container;

a duct for directing the heated air outside the container;

a temperature sensor for sensing the heated air and providing signal representations thereof;

a phase angle sensor for sensing motor phase angle and providing signal representations thereof;

a humidity sensor for sensing the humidity of the heated air entering the duct and providing signal representations thereof; and a controller responsive to the temperature sensor, the phase angle sensor, and the humidity sensor for determining the dryness of the clothing articles in the container as a function of the heated air temperature, the motor phase angle, and the humidity of the heated air, the controller comprising a signal processing unit for processing the signal representations of the heated air temperature, the motor phase angle and the humidity of the heated air and a decision logic unit for determining the dryness of the clothing articles in the container as a function of the processed signal representations of the heated air temperature and the motor phase angle, wherein the decision logic unit decides whether the processed signal representations of the heated air temperature have reached a local maximum and the processed signal representations of the motor phase angle have reached a local minimum.

35. The appliance according to claim 34, wherein the controller further comprises a disable unit for terminating the drying cycle of the appliance when the local maximum and local minimum have been reached.

36. The appliance according to claim 34, wherein the controller comprises a disable unit for terminating the drying cycle of the appliance.

37. The appliance according to claim 34, wherein the controller uses the signal representations of the heated air temperature and the motor phase angle to determine whether a percentage of water content in the clothing articles has reached a predefined level.

38. The appliance according to claim 37, wherein the controller comprises a disable unit for terminating the drying cycle of the appliance as the percentage of water content in the clothing articles reaches the predefined level.

39. The appliance according to claim 37, wherein the predefined level of percentage of water content ranges from about 10% water content to about 3% water content.

40. The appliance according to claim 34, wherein the decision logic decides whether the humidity signal representations are within a predetermined humidity range and whether the difference values of the humidity signal representations are within a predetermined interval.

41. The appliance according to claim 40, wherein the predetermined humidity range is from about 0% humidity to about 30% humidity.

42. The appliance according to claim 40, wherein the predetermined interval is three consecutive difference in humidity values that are within a tolerable band.

43. A clothes dryer, comprising:

a container for accommodating a plurality of clothing articles;

a motor for rotating the container about an axis;

a heater for supplying heated air to the container;

a duct for directing the heated air outside the container;

a temperature sensor for sensing the heated air and providing signal representations thereof;

a phase angle sensor for sensing motor phase angle and providing signal representations thereof;

a humidity sensor for sensing the humidity of the heated air entering the duct and providing signal representations thereof; and a controller responsive to the temperature sensor, the phase angle sensor, and the humidity sensor for determining the dryness of the plurality of clothing articles in the container as a function of the heated air temperature, the motor phase angle, and the humidity of the heated air, the controller comprising a signal processing unit for processing the signal representations of the heated air temperature, the motor phase angle and the humidity of the heated air and a decision logic unit for determining the dryness of the clothing articles in the container as a function of the processed signal representations of the heated air temperature and the motor phase angle, wherein the decision logic unit decides whether the processed signal representations of the heated air temperature have reached a local maximum and the processed signal representations of the motor phase angle have reached a local minimum.

44. The clothes dryer according to claim 43, wherein the controller further comprises a disable unit for terminating the drying cycle of the clothes dryer when the local maximum and local minimum have been reached.

45. The clothes dryer according to claim 43, wherein the controller comprises a disable unit for terminating the drying cycle of the clothes dryer.

46. The clothes dryer according to claim 43, wherein the controller uses the signal representations of the heated air temperature and the motor phase angle to determine whether a percentage of water content in the plurality of clothing articles has reached a predefined level.

47. The clothes dryer according to claim 46, wherein the controller comprises a disable unit for terminating the drying cycle of the clothes dryer as the percentage of water content in the plurality of clothing articles reaches the predefined level.

48. The clothes dryer according to claim 46, wherein the predefined level of percentage of water content ranges from about 10% water content to about 3% water content.

49. The clothes dryer according to claim 43, wherein the decision logic decides whether the humidity signal representations are within a predetermined humidity range and whether the difference values of the humidity signal representations are within a predetermined interval.

50. The clothes dryer according to claim 49, wherein the predetermined humidity range is from about 0% humidity to about 30% humidity.

51. The clothes dryer according to claim 49, wherein the predetermined interval is three consecutive difference in humidity values that are within a tolerable band.

52. A method for drying clothing articles, comprising the steps of:

providing a container for receiving the clothing articles;

rotating the container about an axis with a motor;

supplying heated air to the container;

directing the heated air outside the container with a duct;

sensing temperature of the heated air and providing signal representations thereof;

sensing motor phase angle and providing signal representations thereof;

sensing the humidity of the heated air entering the duct and providing signal representations thereof; and determining the dryness of the clothing articles in the container as a function of the heated air temperature, the motor phase angle, and the humidity of the heated air, wherein the determining dryness comprises deciding whether the signal representations of the heated air temperature have reached a local maximum and the signal representations of the motor phase angle have reached a local minimum.

53. The method according to claim 52, further comprising the step of terminating the drying cycle when the local maximum and local minimum have been reached.

54. The method according to claim 52, wherein the step of determining dryness comprises determining whether a percentage of water content in the clothing articles has reached a predefined level.

55. The method according to claim 54, further comprising the step of terminating the drying cycle as the percentage of water content in the clothing articles reaches the predefined level.

56. The method according to claim 55, wherein the predefined level of percentage of water content of saturated clothing articles ranges from about 10% water content to about 3% water content.

57. The method according to claim 52, wherein step of determining the dryness of the clothing articles comprises determining when the humidity signal representations are within a predetermined humidity range and when difference values of the humidity signal representations are within a predetermined interval.

58. The method according to claim 57, wherein the predetermined humidity range is from about 0% humidity to about 30% humidity.

59. The appliance according to claim 57, wherein the predetermined interval is three consecutive difference in humidity values that are within a tolerable band.

* * * * *